US005383982A

United States Patent [19]

Hauffe et al.

[11] Patent Number: 5,383,982

[45] Date of Patent: Jan. 24, 1995

[54] PROCESS OF PRODUCING PHOSPHATE COATINGS

[75] Inventors: Dieter Hauffe, Frankfurt am Main; Fleischhacker-Jeworrek, Margit, Usingen, both of Germany

[73] Assignee: Metallgesellschaft Aktiengesellschaft, Frankfurt am Main, Germany

[21] Appl. No.: 166,254

[22] Filed: Dec. 13, 1993

[30] Foreign Application Priority Data

Dec. 19, 1992 [DE] Germany ..... 4243214

[51] Int. Cl.[6] ..... C23C 22/10; C23C 22/22; C23C 2/16

[52] U.S. Cl. ..... 148/262; 148/261

[58] Field of Search ..... 148/262, 261

[56] References Cited

U.S. PATENT DOCUMENTS 5,268,041 12/1993 Gehmecker et al. ..... 148/262

FOREIGN PATENT DOCUMENTS 0169047 7/1985 European Pat. Off. .
0370535 7/1989 European Pat. Off. .
0414296 2/1990 European Pat. Off. .
0459541 3/1991 European Pat. Off. .
2231775 12/1974 France .
977633 11/1967 Germany .
0093879 6/1983 Japan ..... 148/262
517049 1/1940 United Kingdom .
1415999 12/1975 United Kingdom .

*Primary Examiner*—Sam Silverberg
*Attorney, Agent, or Firm*—Felfe & Lynch

[57] ABSTRACT

A process of producing a phosphate coating on a metal surface of iron or steel by contacting the surface with an aqueous phosphating solution on the basis of magnesium phosphate. The solution contains 0.2 to 4 g/l magnesium, 1 to 20 g/l phosphate (calculated as $P_2O_5$) and a peroxide compound as an accelerator. The phosphating solution is free of inorganic substances which are not precipitable with calcium hydroxide in a neutral or alkaline medium. It is preferred to use phosphating solutions which also contain activators, which are precipitable with calcium hydroxide in a neutral or alkaline medium.

6 Claims, No Drawings

PROCESS OF PRODUCING PHOSPHATE COATINGS

BACKGROUND OF THE INVENTION

This invention relates to a process of producing phosphate coatings on a metal surface of iron or steel by treating the surface with an aqueous phosphating solution on the basis of magnesium phosphate which contains an accelerator.

In the metal-working industry, phosphate coatings are produced on a large scale by a treatment with aqueous phosphating solutions. The phosphate layers which are formed on the so treated metal surfaces serve particularly for protection against corrosion, as a base for paints, to facilitate cold-working operations and also to reduce friction.

The phosphating solutions employed in such processes may have, e.g., a pH between about 1.8 and 3.8 and may contain zinc ions and phosphate ions as process-determining components. In addition to zinc, other cations, such as ammonium, calcium, cobalt, iron, potassium, copper, sodium, magnesium, and manganese, may be present. In order to accelerate the formation of the phosphate layers, the phosphating baths usually contain oxidizers, such as bromate, chlorate, nitrate, nitrite, organic nitro compounds, perborate, persulfate and hydrogen peroxide. Additionally, an oxygen-containing gas may be used to oxidize iron (II) to iron (III).

A phosphating process of a different kind is the so-called iron-phosphating process or "non-layer-forming phosphating process", in which phosphating solutions usually containing alkali phosphate and, optionally containing phosphates of magnesium, calcium and barium, are employed. Such processes can be carried out at low cost in a comparatively simple manner. The resulting phosphate coating quality is sufficient in many cases, particularly on articles which will not be subjected to strong corrosive action.

The two kinds of processes which have been outlined hereinbefore have in common that the phosphating solutions are contacted with the workpiece surface to be treated by dipping, flooding or spraying. Phosphate layers which are firmly intergrown with the metal are formed during the contacting time by a chemical reaction. The contact period may be from a few seconds to about 15 minutes. The phosphating is followed by a thorough rinsing because any residual phosphating solution left on the treated surface is usually disturbing.

In the so-called "non-layer-forming phosphating process" it is known that the resistance of metal surfaces to corrosive action can be improved by the application of a phosphate coating by a treatment with solutions which mainly contain phosphoric acid and/or a non-layer-forming phosphate (British Patent Specification 517,049). Alkali phosphate, ammonium phosphate, and magnesium phosphate have been mentioned as non-layer-forming phosphates because they are conveniently available and tend to form lesser amounts of sludge than the phosphates of zinc, manganese, cadmium, and iron. The solutions additionally may contain small amounts of nitrite, nitrate or sulfite and are permitted to contain only small amounts of layer-forming phosphates.

However, that process has the disadvantage that the abovementioned contents of nitrite, nitrate, and sulfite and the optional presence of alkali ion or ammonium ion as a non-layer-forming cation can result in the formation of waste waters from the subsequent rinsing. Those waste waters require an expensive aftertreatment before they can be disposed of. The expensive aftertreatment offsets a considerable part of the advantages afforded by the inherently inexpensive "non-layer-forming phosphating processes".

It is an object of the invention to provide a non-layer-forming phosphating process which is free of the known disadvantages, particularly those outlined hereinbefore, but which is inexpensive and can be conveniently carried out and monitored.

THE INVENTION

That object is accomplished in that the process of the kind mentioned first hereinbefore is carried out in accordance with the invention. In the process of the invention the metal surface is contacted with a phosphating solution containing 0.2 to 4 g/l magnesium, 1 to 20 g/l phosphate (calculated as $P_2O_5$) and a peroxide compound as an accelerator but is free of inorganic substances which are not precipitable with calcium hydroxide in a neutral or alkaline medium.

The expression "on the basis of magnesium phosphate" indicates that magnesium phosphate or the cation magnesium constitutes the predominant amount of the phosphate components or cations contained in the phosphating solution.

Particularly suitable accelerators for use in the process of the invention are $H_2O_2$, perphosphate and percarbonate.

In a preferred embodiment of the invention the metal surface is contacted with a phosphating solution which contains $H_2O_2$ as the accelerator. The concentration is preferably selected so that the phosphating solution contains 0.02 to 0.2 g/l $H_2O_2$.

According to another desirable feature of the invention, the metal surface is contacted with a phosphating solution which also contains an activator. Such an activator must be precipitable with calcium hydroxide in a neutral or alkaline medium. The following activators and concentrations are particularly desirable:

0.01 to 0.2 g/l $MoO_3$;
0.01 to 0.2 g/l $WO_3$;
0.01 to 0.2 g/; $VO_3$;
0.1 to 2 g/l F;
0.01 to 0.2 g/l Ni;
0.01 to 0.2 g/l Mn;
0.01 to 0.2 g/l Zn;
0.1 to 1 g/l Ca; and/or
0.001 to 0.02 g/l Cu.

Since the phosphating bath shall be free of components not precipitable by calcium hydroxide in a neutral or alkaline medium, the chemicals used to prepare and replenish the bath must not introduce ions which would result in a formation of water-soluble salts. Further, accelerators consisting, e.g., of bromate, chlorate, nitrate, nitrite or sulfite should not be used. Oxalates, sulfates and optionally also fluorides may be present in the phosphating solution. Whether a given component is permissible in the bath can be tested by adjusting a bath sample to a pH of 8.5 with calcium hydroxide and determining the salt content (anions and cations) of the supernatant water. In that case the salt content of the supernatant water should not exceed the salt content of usual industrial waters, i.e., should not be in excess of about 500 mg/l. In addition to the fact that compounds which are not precipitable with calcium hydroxide in a neutral or alkaline medium must not be used in the preparation of the phosphating solution, care must also be taken in the practice of the invention that such substances are not used in replenishing the bath. For this reason it is recommended to introduce at least part of the cation magnesium which determines the phosphating system in the form of oxide, hydroxide and/or carbonate when replenishing the bath.

The phosphating solution can be applied by conventional processes, such as spraying, dipping or flooding. In dependence on the mode of application and on the desired nature of the phosphate layer, e.g., its thickness, the treating time may be from 5 seconds to a few minutes. The weight of the formed phosphate layer is generally between 0.1 and 1.0 g/m$^2$. Heavier weight layers may be formed under suitable treating conditions. If a separate pH adjustment is required, it will usually be effected with phosphoric acid.

The conventional processing steps may be carried out before and after the phosphating step. For instance, the metal surface is usually cleaned, e.g., by means of an alkaline cleaner in order to remove grease and dirt. If needed, the cleaning may be followed by a pickling treatment to remove rust. Generally, the metal surface is thoroughly rinsed with water between the cleaning and optional pickling and the phosphating treatment.

If the workpiece to be phosphated is only moderately contaminated so that a separate cleaning step is not required or desirable, the phosphating solution used in the process of the invention may contain surfactants or emulsifiers of various kinds, which also may include substances used to clean metals. It will be understood that such substances must be compatible with the phosphating solution.

The phosphating treatment is usually succeeded by a rinsing with water and by an aftertreatment with any desired post-rinsing agent, such as a solution of chromium(VI)/chromium(III). Such an aftertreatment may be followed by an optional rinsing with water. The metal surface is finally dried.

The invention will be explained in more detail and by way of illustration in the following examples.

EXAMPLE 1

Refrigerator housings of RSt 1203 grade steel are prepared by the following five-step process for a powder coating treatment.

Step 1: Cleaning by spraying with a mild alkaline cleaner (5 g/l) at 80° C. for 2 minutes.

Step 2: Rinsing with water at room temperature for 30 seconds.

Step 3: Phosphating by spraying for 2 minutes with a phosphating solution which is at 60° C. and contains 0.55 g/l Mg; 3.3 g/l phosphate (calculated as $P_2O_5$); 30 mg/l $H_2O_2$;
and has a pH of about 5.

Step 4: Rinsing with water at room temperature.

Step 5: Post-rinsing with deionized water; drying.

The phosphate layers formed by the procedure described hereinbefore provided a uniform coverage and constituted a satisfactory base for the subsequent powder coating process.

The wash water from Step 4 had a pH of 5.3 and a conductivity of 320 $\mu$S cm$^{-1}$. It was treated by adding a water suspension of $Ca(OH)_2$ in such an amount that the mixture had a pH of 9.0. When the precipitate had been separated, the treated wash water had a conductivity of 110 $\mu$S cm$^{-1}$ and could be reused as a rinsing water in Step 4.

EXAMPLE 2

In preparation for a subsequent powder coating process, refrigerator housings of the kind mentioned in Example 1 were treated by the following three-step process. The cleaning and phosphatizing treatment were effected with one solution in Step 1.

Step 1: Cleaning and phosphating by spraying for 2 minutes with a solution at a temperature of 50° C. and a pH of about 5.
The solution contained:
0.55 g/l Mg;
3.3 g/l phosphate (calculated as $P_2O_5$);
30 mg/l $H_2O_2$; and
0.5 g/l nonionic surfactant.

Step 2: Rinsing with water at room temperature for 30 seconds

Step 3: Passivating post-rinsing with a CrVI-containing solution, followed by drying.

The above 3 step procedure also resulted in phosphate layers which provided a uniform coverage and, together with the subsequent powder coating process, resulted in an excellent resistance to corrosion.

The wash water from Step 2 was treated as in Example 1. Besides, because the cleaning and phosphating solution from Step 1 contained grease, oil and other impurities it has to be treated from time to time and fresh solution for Step 1 had to be prepared from time to time.

The spent solution of Step 1 had a pH of about 4.9 and a conductivity of 2480 $\mu$S cm$^{-1}$. To remove organic impurities it was subjected to an ultrafiltration. Thereafter, a water suspension of $Ca(OH)_2$ was added in an amount which was sufficient to adjust the pH to 9.0 (conductivity 140 $\mu$S cm$^{-1}$). By that treatment those components of the solution which contributed to the phosphating were removed as well as the impurities which had entered the solution. When the precipitates had been removed, the treated solution could be drained into the sewer system or used for rinsing or for preparing fresh cleaning and phosphating solution.

It will be understood that the specification and examples are illustrative but not limitative of the present invention and that other embodiments within the spirit and scope of the invention will suggest themselves to those skilled in the art.

We claim:

1. A process of producing a phosphate coating on a metal surface of iron or steel by a non-layer forming phosphating process comprising: contacting the surface with an aqueous phosphating solution on the basis of magnesium phosphate which contains an accelerator wherein the phosphating solution contains 0.2 to 4 g/l magnesium, 1 to 20 g/l phosphate (calculated as $P_2O_5$) and, as accelerator, at least one compound selected from the group consisting of hydrogen peroxide, perphosphate and percarbonate, said solution being free of inorganic substances which are not precipitable with calcium hydroxide in a neutral or alkaline medium.

2. The process of claim 1 wherein the metal surface is contacted with a phosphating solution which contains $H_2O_2$ as the accelerator.

3. The process of claim 2 wherein the metal surface is contacted with a phosphating solution which contains 0.02 to 0.2 g/l $H_2O_2$.

4. The process of claim 1 wherein the metal surface is contacted with a phosphating solution which contains activators which are precipitable with calcium hydroxide in a neutral or alkaline medium.

5. The process of claim 4 wherein the metal surface is contacted with a phosphating solution which contains at least one activator selected from the group consisting of 0.01 to 0.2 g/l $MoO_3$;
0.01 to 0.2 g/l $WO_3$;
0.01 to 0.2 g/l $VO_3$;
0.1 to 2 g/l F;
0.01 to 0.2 g/l Ni;
0.01 to 0.2 g/l Mn;
0.01 to 0.2 g/l Zn;
0.1 to 1 g/l Ca; and
0.001 to 0.02 g/l Cu.

6. The process of claim 1 wherein the metal surface is contacted with a phosphating solution containing a surfactant and/or an emulsifier.

* * * * *